US010531527B1

(12) United States Patent
Milanesi et al.

(10) Patent No.: US 10,531,527 B1
(45) Date of Patent: Jan. 7, 2020

(54) CIRCUIT FOR CONTROLLING DELIVERY OF AN ELECTRICAL SIGNAL TO ONE OR MORE LIGHT-EMITTING DIODE STRINGS

(71) Applicant: Infineon Technologies AG, Neubiberg (DE)

(72) Inventors: Paolo Milanesi, Padua (IT); Fabio Fragiacomo, Montegrotto Terme (IT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 16/396,126

(22) Filed: Apr. 26, 2019

(51) Int. Cl.
*H05B 37/00* (2006.01)
*H05B 33/08* (2006.01)

(52) U.S. Cl.
CPC ..... *H05B 33/0815* (2013.01); *H05B 33/089* (2013.01); *H05B 33/0827* (2013.01)

(58) Field of Classification Search
CPC ..... H05B 33/0803; H05B 33/0827; H05B 33/0809; H05B 33/0821; H05B 41/34; H05B 39/09; H05B 41/28; H05B 41/295; H05B 41/2827; H05B 41/3925; H05B 41/24; H05B 41/2806; H05B 33/0815; H05B 33/0818; H05B 41/2828; H05B 41/3921; H05B 41/3927; H05B 37/029; H05B 37/02; H05B 41/42; H05B 37/0254; H05B 33/0851; F21Y 2101/02; Y02B 20/202; Y02B 20/22; H01J 65/048; H01J 65/044; F21W 2131/406; G05B 19/14
See application file for complete search history.

(56) References Cited

U.S. PATENT DOCUMENTS

2018/0035499 A1* 2/2018 Busse ..... H05B 33/0815
2018/0110099 A1* 4/2018 Shteynberg ..... H05B 33/083

OTHER PUBLICATIONS

"Buck-boost converter using the STM32F334 Discovery kit," AN4449 Application note, accessed from www.st.com, Sep. 2014, 34 pp.
Infineon Technologies AG, "H-Bridge DC/DC Controller with SPI Interface," Datasheet TLD5541-1, Rev. 1.1, Feb. 8, 2018, 81 pp.

* cited by examiner

*Primary Examiner* — Minh D A
(74) *Attorney, Agent, or Firm* — Shumaker & Sieffert, P.A.

(57) ABSTRACT

This disclosure includes systems, methods, and techniques for controlling delivery of power to one or more strings of light-emitting diodes (LEDs). For example, a circuit is configured to monitor current through one or more strings of LEDs. The circuit includes a power converter unit, where the power converter unit is configured to receive an input signal from a power source, and where the power converter unit is configured to deliver an output signal to the one or more strings of LEDs, and a set point unit configured to deliver a set point signal to the power converter unit. Additionally, the circuit includes a correction unit configured to deliver, based on an input parameter value, an output parameter value, and a set point parameter value, a correction signal to the power converter unit.

20 Claims, 9 Drawing Sheets

CIRCUIT FOR CONTROLLING DELIVERY OF AN ELECTRICAL SIGNAL TO ONE OR MORE LIGHT-EMITTING DIODE STRINGS

TECHNICAL FIELD

This disclosure relates circuits for driving and controlling strings of light-emitting diodes.

BACKGROUND

Drivers are often used to control a voltage, current, or power at a load. For instance, a light-emitting diode (LED) driver may control the power supplied to a string of light-emitting diodes. Some drivers may include a DC to DC power converter, such as a buck-boost, buck, boost, or another DC to DC converter. Such DC to DC power converters may be used to control and possibly change the power at the load based on a characteristic of the load. DC to DC power converters may be especially useful for regulating current through LED strings. In some cases, LED driver circuits may accept an input signal including an input current and an input voltage and deliver an output signal including an output current and an output voltage. In some such cases, an LED driver circuit may regulate at least some aspects of the input signal and the output signal, such as controlling the output current emitted by the LED driver circuit.

SUMMARY

In general, this disclosure is directed to devices, systems, and techniques for delivering an electrical signal to one or more strings of light-emitting diodes (LEDs) using a circuit and regulating at least one parameter of the electrical signal using the circuit. For example, the circuit includes a power converter unit and a set point unit, the set point unit configured to deliver a set point signal to the power converter unit. Based on the set point signal, the power converter unit may regulate the output signal to be proportional to a set point parameter value associated with the set point signal. In some cases, when a parameter associated with the input signal, the output signal, or the set point signal changes, the circuit may respond by causing an overshoot in a parameter associated with the output signal. Accordingly, the circuit includes a correction unit that is configured to accept a set of inputs including, for example, an input parameter value proportional to the input signal, an output parameter value proportional to the output signal, and a set point value proportional to the set point signal. The correction unit delivers, based on any one or more of the input parameter value, the output parameter value, and the set point parameter value, a correction signal to the power converter unit, causing the power converter unit to decrease an amount of overshoot in the parameter associated with the output signal. It may be beneficial to decrease the amount of overshoot in the parameter associated with the output signal since such an overshoot may cause damage to the one or more strings of LEDs.

In some examples, a circuit is configured to monitor current through one or more strings of LEDs. The circuit includes a power converter unit, where the power converter unit is configured to receive an input signal from a power source, and where the power converter unit is configured to deliver an output signal to the one or more strings of LEDs, the output signal including an output voltage and an output current and a set point unit configured to deliver a set point signal to the power converter unit, where the power converter unit is configured to regulate the output current to be proportional to a set point parameter value associated with the set point signal. Additionally, the circuit includes a correction unit configured to receive an input parameter value, where the input parameter value is proportional to the input signal, receive an output parameter value, where the output parameter value is proportional to the output voltage, receive a set point parameter value, where the set point parameter value is proportional the set point signal, and deliver, based on the input parameter value, the output parameter value, and the set point parameter value, a correction signal to the power converter unit.

In some examples, a system includes one or more strings of light-emitting diodes (LEDs), a power source, and a circuit configured to monitor current through one or more strings of LEDs. The circuit includes a power converter unit, where the power converter unit is configured to receive an input signal from a power source, and where the power converter unit is configured to deliver an output signal to the one or more strings of LEDs, the output signal including an output voltage and an output current, a set point unit configured to deliver a set point signal to the power converter unit, where the power converter unit is configured to regulate the output current to be proportional to a set point parameter value associated with the set point signal, and a correction unit. The correction unit is configured to receive an input parameter value, where the input parameter value is proportional to the input signal, receive an output parameter value, where the output parameter value is proportional to the output voltage, receive a set point parameter value, where the set point parameter value is proportional the set point signal, and deliver, based on the input parameter value, the output parameter value, and the set point parameter value, a correction signal to the power converter unit.

In some examples, a method includes receiving, by a power converter unit of a circuit configured to monitor current through one or more strings of light-emitting diodes (LEDs), an input signal from a power source, delivering, by the power converter unit, an output signal to the one or more strings of LEDs, the output signal including an output voltage and an output current, and delivering, by a set point unit of the circuit, a set point signal to the power converter unit, the power converter unit regulating the output current to be proportional to a set point parameter value associated with the set point signal. Additionally, the method includes receiving, by a correction unit, an input parameter value, where the input parameter value is proportional to the input signal, receiving, by the correction unit, an output parameter value, where the output parameter value is proportional to the output voltage, receiving, by the correction unit, a set point parameter value, where the set point parameter value is proportional the set point signal, and delivering, by the correction unit and based on the input parameter value, the output parameter value, and the set point parameter value, a correction signal to the power converter unit.

The summary is intended to provide an overview of the subject matter described in this disclosure. It is not intended to provide an exclusive or exhaustive explanation of the systems, devices, and methods described in detail within the accompanying drawings and description below. Further details of one or more examples of this disclosure are set forth in the accompanying drawings and in the description below. Other features, objects, and advantages will be apparent from the description and drawings, and from the claims.

BRIEF DESCRIPTION OF DRAWINGS

Like reference characters denote like elements throughout the description and figures.

DETAILED DESCRIPTION

Some systems may use a power converter, such as a direct current (DC) to DC converter to control an electrical signal supplied to one or more strings of light-emitting diodes (LEDs). This disclosure is directed to a circuit including a power converter unit, a set point unit, and a correction unit, where the correction unit is configured to decrease an overshoot in an output signal delivered by the power converter unit to the one or more strings of LEDs. Such an overshoot, in some cases, may be caused by a change in one or more parameters associated with the circuit such as a set point parameter value corresponding to a set point signal emitted by the set point unit. The techniques and circuits described herein may be especially useful with vehicle lighting applications that include one or more strings of LEDs.

Figure 1:
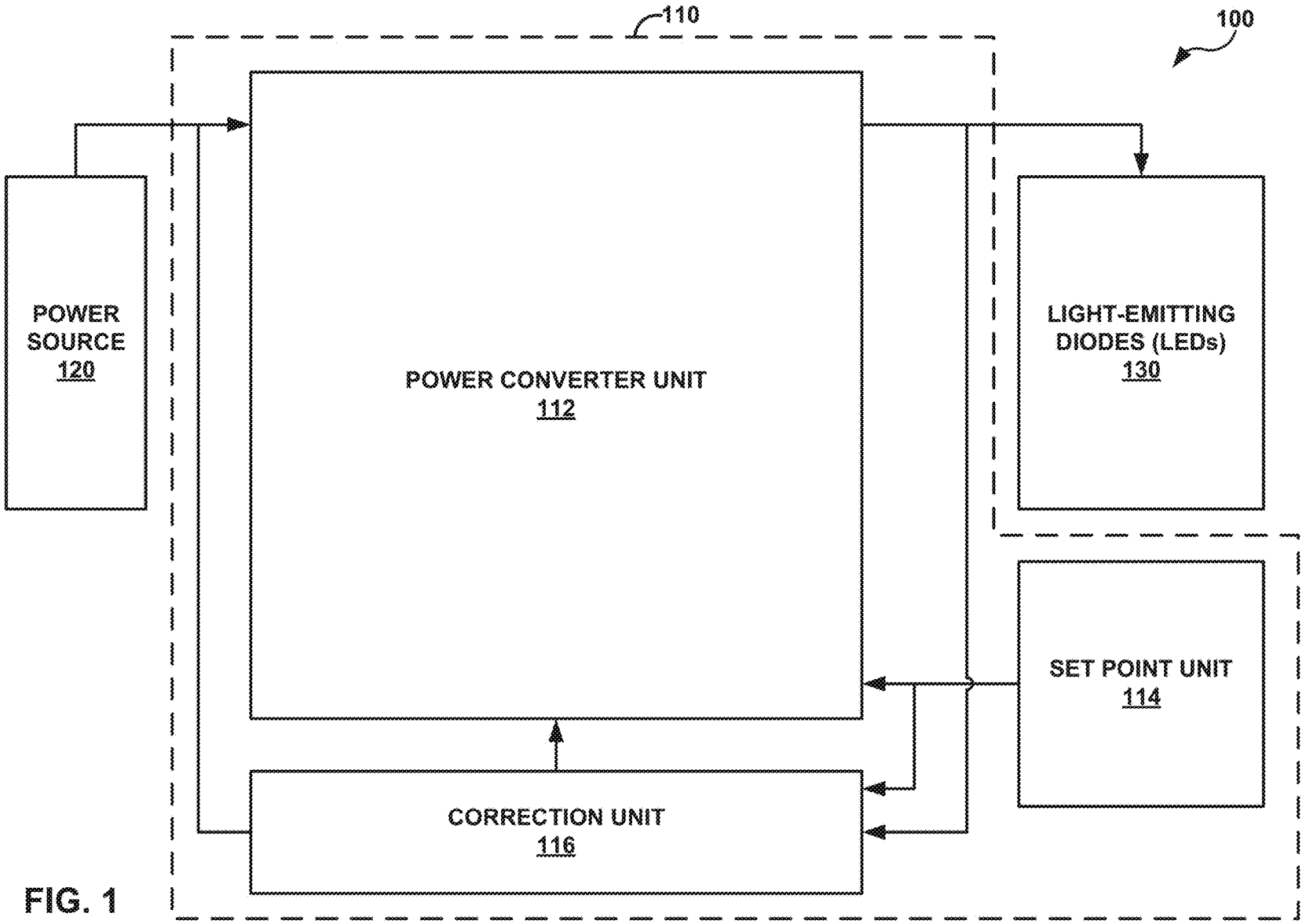
FIG. 1 is a block diagram illustrating an exemplary system including a circuit for accepting an input signal from a power source and delivering an output signal to one or more strings of light-emitting diodes (LEDs), in accordance with one or more techniques of this disclosure.

FIG. 1 is a block diagram illustrating an exemplary system 100 including a circuit 110 for accepting an input signal from power source 120 and delivering an output signal to one or more strings of LEDs 130, in accordance with one or more techniques of this disclosure. As illustrated in the example of FIG. 1, system 100 includes circuit 110, power source 120, and LEDs 130. Circuit 110 includes power converter unit 112, set point unit 114, and correction unit 116.

Circuit 110 may include circuit elements including resistors, capacitors, inductors, diodes, semiconductor switches, and other semiconductor elements. In the example illustrated in FIG. 1, circuit 110 includes power converter unit 112. Power source 120 may supply an input signal to power converter unit 112, thus, powering circuit 110. Furthermore, power converter unit 112 may provide output signal to LEDs 130, which may represent a load supplied with energy by power converter unit 112. The input signal, in some cases, may include an input current and an input voltage. Additionally, the output signal may include an output current and an output voltage. In some cases, power converter unit 112 includes a DC-to-DC power converter configured to regulate the output signal delivered to LEDs 130. In some examples, the DC-to-DC power converter includes a switch/inductor unit such as an H bridge. An H bridge uses a set of switches, often semiconductor switches, to convert electrical power. In some examples, the switch/inductor unit acts as a buck-boost converter. For instance, a buck-boost converter is configured to regulate the output voltage delivered to LEDs 130 using at least two operational modes including a buck mode and a boost mode. Power converter unit 112 may control semiconductor switches of the buck-boost converter to alternate the mode of the buck-boost converter (e.g., change the operation mode of the buck-boost converter from buck mode to boost mode and vice versa). In the example illustrated in FIG. 1, the semiconductor switches of power converter unit 112 may include transistors, diodes, or other semiconductor elements. In buck mode, the buck-boost converter of power converter unit 112 may step down voltage and step up current from the input of power converter unit 112 to the output of power converter unit 112. In boost mode, the buck-boost converter of power converter unit 112 may step up voltage and step down current from the input of power converter unit 112 to the output of power converter unit 112.

Set point unit 114 may be configured to deliver a set point signal to power converter unit 112. In some examples, power converter unit 112 is configured to regulate the output current delivered to LEDs 130 to be proportional to a set point parameter value associated with the set point signal. In other words, set point unit 114 may control the output current delivered by power converter unit 112 to LEDs 130. For example, the set point signal may include a set point current value, a set point voltage value, a set point signal frequency, a set point signal duty cycle, or any combination thereof. In some examples where the set point signal includes a set point voltage value, the set point voltage value may be within a range from 5 Volts (V) to 10 V. As such, the range of set point voltage values (e.g., 5 V to 10 V) may correspond to a possible range of output currents delivered by power converter unit 112 to LEDs 130. For example, the possible range of output current values may extend from 0 Amperes (A) to 3 A. In this way, if the set point voltage value is 7.5 V (e.g., halfway along the range of set point voltage values), power converter unit 112 will deliver a on output current of 1.5 A (e.g., halfway along the range of output current values. A relationship between the set point signal and the output current may, in some cases, be a linear relationship.

During transient phases of circuit 110 such as following changes in the set point signal, changes in the input signal, changes in the output signal, or any combination thereof, an output signal overshoot may occur in the output signal delivered by power converter unit 112 to LEDs 130. For example, if the set point signal changes such that the output current drops from 1.5 A to 0.3 A, the output current may first drop below 0.3 A then spike above (e.g., overshoot) 0.3 A before settling at 0.3 A. Additionally, in some examples, if the output signal changes such that LEDs 130 draw a greater amount of output voltage from power converter unit 112 while output current remains constant in the long term, an output current overshoot may occur in the short term during the transient phase corresponding to the increase in output voltage delivered by power converter unit 112 to LEDs 130. Output current overshoot may, in some examples, cause damage to components of circuit 110 and LEDs 130. Additionally, in some examples, output current overshoot may lead to inaccuracies in regulating the output signal delivered by power converter unit 112. As such, it may be beneficial to decrease an amount of current overshoot caused by a change in the input signal, a change in the output signal, a change in the set point signal, or any combination thereof.

Correction unit 116 may be configured to decrease an amount of output current overshoot caused during transient phases of circuit 110. For example, correction unit 116 may be configured to receive an input parameter value, where the input parameter value is proportional to the input signal delivered to power converter unit 112 by power source 120. For example, the input parameter value may be proportional to any one or more of an input current magnitude, an input voltage magnitude, or a frequency of the input signal. Correction unit 116 may receive an output parameter value, where the output parameter value is proportional to the output voltage. For example, the output parameter value may be proportional to any one or more of an output current magnitude, an output voltage magnitude, or a frequency of the output signal. Additionally, correction unit 116 may receive a set point parameter value, where the set point parameter value is proportional the set point signal delivered by set point unit 114. For example, the set point parameter value may be proportional to any one or more of a set point current magnitude, a set point voltage magnitude, a frequency of the set point signal, or a duty cycle of the set point signal.

Correction unit 116 may deliver, based on the input parameter value, the output parameter value, and the set point parameter value, a correction signal to power converter unit 112. The correction signal, in some cases, may cause power converter unit 112 to decrease an amount of output current overshoot that occurs due to transient phases of circuit 110. In some examples, correction unit 116 may determine, based on the input parameter value and the output parameter value, a gain of power converter unit 112. For example, a ration of the output voltage to the input voltage represents a voltage gain of power converter unit 112. Correction unit 116 may, in some cases, deliver the correction signal based on the voltage gain of power converter unit 112. Additionally, in some examples, correction unit 116 may determine a difference between the set point parameter value and a maximum set point parameter value. Correction unit 116 may deliver the correction signal based on the difference between the set point parameter value and a maximum set point parameter value.

Power source 120 may represent one or more batteries configured to provide power (e.g., the input signal) to circuit 110. Power source 120, for example, may include a plurality of cells arranged in series. In some examples, the plurality of cells includes a plurality of lithium-ion cells. In other examples, the plurality of cells includes lead-acid cells, nickel metal hydride cells, or other materials. In some examples, a maximum voltage output of power source 120 is within a range from 10 V to 14 V. In one example, a maximum voltage output of power source 120 is 12 V. However, the maximum voltage output of power source 120 may be another value or range of values.

LEDs 130 may include one or more strings of LEDs. LEDs 130 may include any suitable semiconductor light source. In some examples, an LED may include a p-n junction configured to emit light when activated. In some examples, LEDs 130 may be included in a headlight assembly for automotive applications. For instance, LEDs 130 may include a matrix, a string, or more than one string of light-emitting diodes to light a road ahead of a vehicle. As used herein, a vehicle may refer to motorcycles, trucks, boats, golf carts, snowmobiles, heavy machines, or any type of vehicle that uses directional lighting. In some examples, LEDs 130 include a first string of LEDs including a set of high-beam LEDs and a set of low-beam LEDs. In some cases, system 100 may toggle between activating the set of low-beam LEDs, activating the set of high-beam LEDs, activating both the set of low-beam LEDs and the set of high-beam LEDs, and deactivating both the set of low-beam LEDs and the set of high-beam LEDs. Additionally, LEDs 130 may include a second string of LEDs representing a set of baseline LEDs. For example, if both of the set of low-beam LEDs and the set of high-beam LEDs are deactivated, circuit 110 may deliver the output signal to the second string of LEDs such that the set of baseline LEDs are activated. The second string of LEDs may, in some cases, give off a smaller amount of light than the first string of LEDs and draw a smaller amount of current from circuit 110 than the first string of LEDs.

Figure 2:
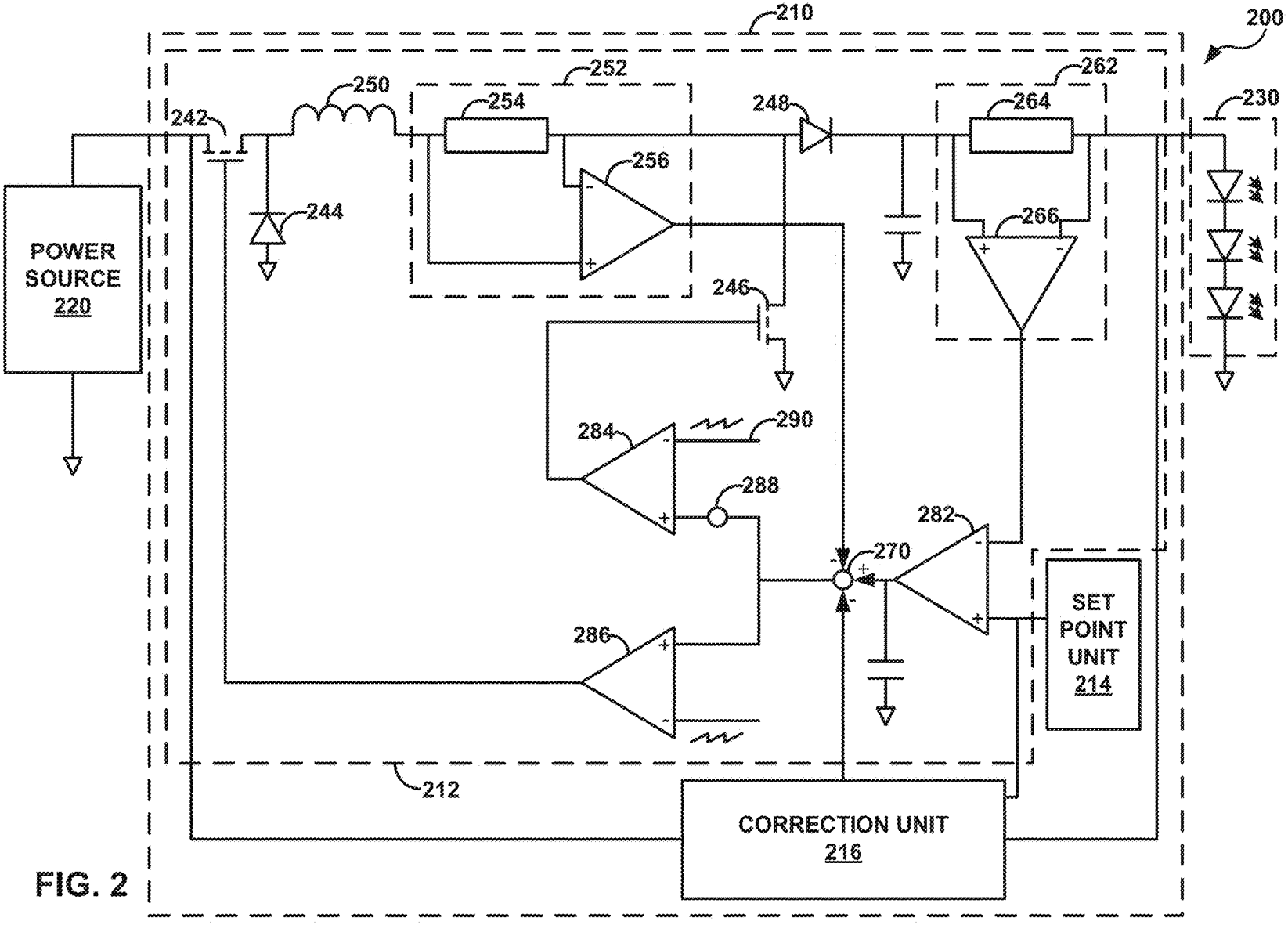
FIG. 2 is a circuit diagram illustrating an exemplary system including a circuit for accepting an input signal from a power source and delivering an output signal to one or more strings of LEDs, in accordance with one or more techniques of this disclosure.

FIG. 2 is a circuit diagram illustrating an exemplary system 200 including a circuit 210 for accepting an input signal from power source 220 and delivering an output signal to one or more strings of LEDs 230, in accordance with one or more techniques of this disclosure. As illustrated in FIG. 2, system 200 includes circuit 210, power source 220, and LEDs 230. Circuit 210 includes power converter unit 212, set point unit 214, and correction unit 216. Power converter unit 212 includes first switching element 242, first diode 244, second switching element 246, second diode 248, inductor 250, first current sensor 252, second current sensor 262, node 270, amplifier 282, amplifier 284, amplifier 286, and offset unit 288. First current sensor 252 includes first current sensing resistor 254 and first current sensing amplifier 256. Second current sensor 262 includes second current sensing resistor 264 and second current sensing amplifier 266. Circuit 210 may be an example of circuit 110 of FIG. 1. Power converter unit 212 may be an example of power converter unit 112 of FIG. 1. Set point unit 214 may be an example of set point unit 114 of FIG. 1. Correction unit 216 may be an example of correction unit 116 of FIG. 1. Power source 220 may be an example of power source 120 of FIG. 1. LEDs 230 may be an example of LEDs 130 of FIG. 1.

Power converter unit 212 may include a switch/inductor unit that acts as a buck-boost converter. The H-bridge may be represented by first switching element 242, first diode 244, second switching element 246, second diode 248, and inductor 250. Each of first switching element 242 and second switching element 246 (collectively, "switching elements 242, 246") may, in some cases, include power switches such as, but not limited to, any type of field-effect transistor (FET) including any combination of metal-oxide-semiconductor field-effect transistors (MOSFETs), bipolar junction transistors (BJTs), insulated-gate bipolar transistors (IGBTs), junction field effect transistors (JFETs), high electron mobility transistors (HEMTs), or other elements that use voltage for control. Additionally, switching elements 242, 246 may include n-type transistors, p-type transistors, and power transistors, or any combination thereof. In some examples, switching elements 242, 246 include vertical transistors, lateral transistors, and/or horizontal transistors. In some examples, switching elements 242, 246 include other analog devices such as diodes and/or thyristors. In some examples, switching elements 242, 246 may operate as switches and/or as analog devices.

In some examples, each of switching elements 242, 246 include three terminals: two load terminals and a control terminal. For MOSFET switches, each of switching elements 242, 246 may include a drain terminal, a source terminal, and at least one gate terminal, where the control terminal is a gate terminal. For BJT switches, the control terminal may be a base terminal. Current may flow between the two load terminals of each of switching elements 242, 246, based on the voltage at the respective control terminal. Therefore, electrical current may flow across switching elements 242, 246 based on control signals delivered to the respective control terminals of switching elements 242, 246. In one example, if a voltage applied to the control terminals of switching elements 242, 246 is greater than or equal to a voltage threshold, switching elements 242, 246 may be activated, allowing switching elements 242, 246 to conduct electricity. Furthermore, switching elements 242, 246 may be deactivated when the voltage applied to the respective control terminals of switching elements 242, 246 is below the threshold voltage, thus preventing switching elements 242, 246 from conducting electricity. Power converter unit 112 may be configured to independently control switching elements 242, 246 such that one, both, or none of switching elements 242, 246 may be activated at a point in time.

Switching elements 242, 246 may include various material compounds, such as Silicon, Silicon Carbide, Gallium Nitride, or any other combination of one or more semiconductor materials. In some examples, silicon carbide switches may experience lower switching power losses. Improvements in magnetics and faster switching, such as Gallium Nitride switches, may allow switching elements 242, 246 to draw short bursts of current from power source 220. These higher frequency switching elements may require control signals (e.g., voltage signals delivered by power converter unit 212 to respective control terminals of switching elements 242, 246) to be sent with more precise timing, as compared to lower-frequency switching elements.

In the example illustrated in FIG. 2, first diode 244 and second diode 248 (collectively, "diodes 244, 248") represent semiconductor devices. In the field of circuit electronics, diodes include semiconductor components which allow current to flow across the diode in a first direction (e.g., "forward direction") and prevent current from flowing across the diode in a second direction (e.g., "reverse direction"). A diode may include an anode and a cathode, and current may be able to pass through the diode in the forward direction from the anode to the cathode. However, current may be unable to pass through the diode in the reverse direction from the cathode to the anode. For example, a cathode of first diode 244 may be electrically connected to first switching element 242 and inductor 250 and an anode of first diode 244 may be electrically connected to ground. Additionally, a cathode of second diode 248 may be electrically connected to second current sensor 262 and an anode of second diode 248 may be electrically connected to first current sensor 252 and second switching element 246.

Inductor 250 is a component of power converter unit 212 according to the example illustrated in FIG. 2. Inductors are electrical circuit components that resist change in the amount of current passing through the inductor. In some examples, inductors include an electrically conductive wire wrapped in a coil. As current passes through the coil, a magnetic field is created in the coil, and the magnetic field induces a voltage across the inductor. An inductor defines an inductance value, and the inductance value is the ratio of the voltage across the inductor to the rate of change of current passing through the inductor. Therefore, when inductor 250 is charged with a magnetic field and placed in series with power source 220 and LEDs 230, the voltage across inductor 250 is configured to boost the magnitude of the output voltage delivered to load LEDs 230. Inductor 250 is also configured to buck the magnitude of the output voltage delivered to LEDs 230 when first switching element 242 is deactivated, isolating LEDs 230 from power source 220 and decreasing the output voltage delivered to LEDs 230 to the voltage across inductor 250 charged with a magnetic field.

The switch/inductor unit (e.g., first switching element 242, first diode 244, second switching element 246, second diode 248, and inductor 250) is configured to regulate the output voltage delivered to LEDs 230 using at least two operational modes including a buck mode and a boost mode. Power converter unit 212 may control first switching element 242 and second switching element 246 to alternate the mode of the switch/inductor unit (e.g., change the operation mode of the switch/inductor unit from buck mode to boost mode and vice versa). In the example illustrated in FIG. 1, first switching element 242 and second switching element 246 may include transistors, diodes, or other semiconductor elements. In buck mode, the switch/inductor unit may step down voltage and step up current from the input of power converter unit 212 to the output of power converter unit 212. In boost mode, the switch/inductor unit may step up voltage and step down current from the input of power converter unit 212 to the output of power converter unit 212.

In some examples, while the switch/inductor unit is in buck mode, second switching element 246 is deactivated and first switching element 242 alternates between being activated and being deactivated. When first switching element 242 is activated, an electrical current passes through first switching element 242, inductor 250, and second diode 248, charging inductor 250. When first switching element 242 is deactivated, the power converter unit 212 is disconnected from power source 220 and inductor 250 discharges, causing an electrical current to flow from ground through first diode 244, inductor 250, and second diode 248. When inductor 250 discharges, power converter unit 212 may step down, or "buck," an output voltage delivered by power converter unit 212 to LEDs 230. Additionally, power converter unit 212 may step up an output current delivered by power converter unit 212 to LEDs 230.

In some examples, while the switch/inductor unit is in boost mode, first switching element 242 is on and second switching element 246 alternates between being activated and being deactivated. When second switching element 246 is activated, an electrical current flows from power source 220 through first switching element 242, inductor 250, and second switching element 246, charging inductor 250. When second switching element 246 is deactivated, inductor 250 discharges and an electrical current flows from power source 220 through first switching element 242, inductor 250, and second diode 248 to LEDs 230, thus stepping up, or "boosting" an output voltage delivered to LEDs 130. Additionally, during boost mode, power converter unit 121 may step down a current delivered to LEDs 230.

In order to regulate one or more aspects of the output signal (e.g., the output current and the output voltage)

delivered to LEDs 230, it may be beneficial for power converter unit 212 to obtain a parameter indicative of the current across inductor 250 and a parameter indicative of an output current delivered to LEDs 230. By obtaining such parameters, power converter unit 212 may more accurately regulate the one or more aspects of the output signal.

First current sensor 252 may sense a current across inductor 250 and second current sensor 262 may sense an output current delivered to LEDs 230 by power converter unit 212. In the example illustrated in FIG. 2, first current sensor 252 includes first current sensing resistor 254 and first current sensing amplifier 256. Second current sensor 264 includes second current sensing resistor 264 and second current sensing amplifier 266. Ohm's law dictates that a voltage across a resistor is equal to a resistance of the resistor times a magnitude of a current across the resistor (V=I*R). As such, a current across first current sensing resistor 254 is equal to a voltage across first current sensing resistor 254 divided by a resistance value (in ohms (a)) of first current sensing resistor 254. First current sensing amplifier 256, in some cases, may output a first current sensor signal correlated with a current across the first current sensing resistor 254. As such, first current sensing amplifier 256 may output the first current sensor signal correlated with a current across inductor 250. Additionally, a current across second current sensing resistor 264 is equal to a voltage across second current sensing resistor 264 divided by a resistance value (in ohms (Ω)) of second current sensing resistor 264. Second current sensing amplifier 266, in some cases, may output a second current sensor signal correlated with a current across the second current sensing resistor 264. As such, second current sensing amplifier 266 may output the second current sensor signal correlated with an output current delivered to LEDs 230.

Node 270, in some examples, receives the first current sensor signal and receives a comparison signal, where the comparison signal is correlated with a difference between the set point signal delivered by set point unit 214 and the second current sensor signal delivered by the second current sensor 262. For example, amplifier 282 may produce the comparison signal which is correlated with the difference between the set point signal and the second current sensor signal, and amplifier 282 may deliver the comparison signal to node 270. Additionally, node 270 receives a correction signal from correction unit 216 and delivers a control signal to any one or more of amplifier 284 and amplifier 286. The control signal, in some cases, drives the activation and deactivation of switching elements 242, 246 such that power converter unit 212 can accurately regulate one or more aspects of the output signal delivered to LEDs 130. In some examples, the control signal represents a subtraction of the correction signal and the first current sensor signal from the comparison signal.

In some examples where the switch/inductor unit of power converter unit 212 is acting in the boost mode, the comparison signal ($V_{comp}$) may be given by the following equation:

$$V_{comp}=V_{offset}+V_{slope}\cdot D+V_{peak}+V_{correction} \quad \text{(eq. 1)}$$

In equation 1, $V_{comp}$ may represent the comparison signal, $V_{offset}$ may represent an offset signal given by offset unit 288, $V_{slope}$ may represent an input 290 to amplifier 284, D may represent a duty cycle of second switching element 246, $V_{peak}$ may represent the first current sensor signal output by first current sensor 252, and $V_{correction}$ may represent the correction signal delivered by correction unit 216.

When the switch/inductor unit of power converter unit 212 is operating in buck mode, there may be a linear relationship between a voltage gain of power converter unit 212 (e.g., a ratio of the output voltage of power converter unit 212 to the input voltage of power converter unit 212) and the comparison signal received by node 270. Additionally, when the switch/inductor unit of power converter unit 212 is operating in boost mode, there may be a nonlinear relationship between the voltage gain of power converter unit 212 and the comparison signal received by node 270. In some cases, the nonlinear relationship between the voltage gain of power converter unit 212 and the comparison signal received by node 270 may depend on the output current delivered by power converter unit 212 to LEDs 230.

For example, when the switch/inductor unit of power converter unit 212 is operating in buck mode, the first current sensor signal $V_{peak}$ and the comparison signal $V_{comp}$ may be given by the following two equations:

$$V_{peak}=I_{L,peak}\cdot R_{ext} \quad \text{(eq. 2)}$$

$$V_{comp}=V_{offset}+V_{slope}\cdot D+I_{L,peak}\cdot R_{ext}+V_{correction} \quad \text{(eq. 3)}$$

In equations 2 and 3, $I_{L,peak}$ represents a peak current across inductor 250. As such, $I_{L,peak}$ represents a peak current across first current sensing resistor 254 of first current sensor 252, which measures the current across inductor 250. Additionally, $R_{ext}$ represents the resistance value of first current sensing resistor 254. In the example of FIG. 2, a current ripple factor associated with the current across inductor 250 may be less than 30%. As such, the peak current across inductor 250 ($I_{L,peak}$), an average current across inductor 250, and a valley current across inductor 250 may be substantially the same. As such, the peak current across inductor 250 may, in some cases, be substituted for (e.g., used in place of) the average current across inductor 250 and/or the valley current across inductor 250 in examples where the switch/inductor unit of power converter unit 212 is operating in buck mode and in examples where the switch/inductor unit of power converter unit 212 is operating in boost mode. When the switch/inductor unit of power converter unit 212 is operating in boost mode, the first current sensor signal $V_{peak}$ and the comparison signal $V_{comp}$ may be given by the following two equations:

$$V_{peak} = I_{out}\cdot R_{ext}\cdot\frac{V_o}{V_i} \quad \text{(eq. 4)}$$

$$V_{comp} = V_{offset} + V_{slope}\cdot D + I_{out}\cdot R_{ext}\cdot\frac{V_o}{V_i} + V_{correction} \quad \text{(eq. 5)}$$

In equations 4 and 5, $I_{out}$ represents the output current delivered by power converter unit 212 to LEDs 230, $R_{ext}$ represents the resistance value of first current sensing resistor 254, $V_o$ represents the output voltage delivered by power converter unit 212 to LEDs 230, and $V_i$ represents the input voltage received by power converter unit 212 from power source 220. As seen in equations 4 and 5, the comparison signal ($V_{comp}$) depends on the a function of the voltage gain $$\left(\frac{V_o}{V_i}\right)$$

of power converter unit 212 and the output current ($I_{out}$) from power converter unit 212 while the switch/inductor unit of power converter unit 212 is operating in boost mode. As such, while boost mode is activated, $V_{comp}$ and $$\frac{V_o}{V_i}$$

have a nonlinear relationship where the nonlinear relationship depends on $I_{out}$. For example, a separate $$V_{comp} \text{ vs. } \frac{V_o}{V_i}$$

curve may exist for each value of $I_{out}$.

In this way, if set point unit 214 decreases the set point signal such that output current decreases from a first output current value to a second output current value, the output voltage from power converter unit 212 may increase while the comparison signal received by node 270 decreases. Such a decrease in the comparison signal and increase in output voltage may cause the output current to decrease from the first output current value to below the second output current value, then overshoot the second output current value before settling at the second output current value. Additionally, if the output signal changes such that LEDs 230 draw a greater amount of output voltage from power converter unit 212 while output current remains constant in the long term, an output current overshoot may occur in the short term during the transient phase corresponding to the increase in output voltage delivered by power converter unit 212 to LEDs 230. Output current overshoot may, in some examples, cause damage to components of circuit 210 and LEDs 230. Additionally, in some examples, output current overshoot may lead to inaccuracies in regulating the output signal delivered by power converter unit 212. As such, it may be beneficial to decrease an amount of current overshoot caused by a change in the input signal, a change in the output signal, a change in the set point signal, or any combination thereof.

Correction unit 216 may decrease an amount of output current overshoot that occurs due to changes in the input signal, changes in the output signal, changes in the set point signal, or any combination thereof. For example, correction unit 216 may be configured to receive an input parameter value, where the input parameter value is proportional to the input signal delivered to power converter unit 212 by power source 220. For example, the input parameter value may be proportional to any one or more of an input current magnitude, an input voltage magnitude, or a frequency of the input signal. Correction unit 216 may receive an output parameter value, where the output parameter value is proportional to the output voltage delivered to LEDs 230 by power converter unit 212. For example, the output parameter value may be proportional to any one or more of an output current magnitude, an output voltage magnitude, or a frequency of the output signal. Additionally, correction unit 216 may receive a set point parameter value, where the set point parameter value is proportional the set point signal delivered by set point unit 214. For example, the set point parameter value may be proportional to any one or more of a set point current magnitude, a set point voltage magnitude, a frequency of the set point signal, or a duty cycle of the set point signal.

Correction unit 216 may deliver, based on the input parameter value, the output parameter value, and the set point parameter value, a correction signal to node 270 of power converter unit 212. In some examples, while the switch/inductor unit of power converter unit 212 is operating in the boost mode, the correction signal ($V_{correction}$) may be given by:

$$V_{correction} = R_{ext} \cdot \frac{V_o}{V_i}(I_{out,max} - I_{out}) \quad \text{(eq. 6)}$$

In equation 6, $V_o$ may represent the output parameter value received by correction unit 216, $V_i$ may represent the input parameter value received by correction unit 216, and $I_{out}$ may represent set point parameter value received by correction unit 216. $I_{out,max}-I_{out}$ may represent a difference between a maximum set point parameter value and the set point parameter value received by correction unit 216. When equation 6 is combined with equation 5, the comparison signal ($V_{comp}$) received by node 270 may be given by:

$$V_{comp} = V_{offset} + V_{slope} \cdot D + R_{ext} \cdot \frac{V_o}{V_i} \cdot I_{out,max} \quad \text{(eq. 7)}$$

In this way, the comparison signal may depend on the voltage gain $$\left(\frac{V_o}{V_i}\right)$$

or power converter unit 212 and the maximum output current/maximum set point parameter value ($I_{out,max}$) and not depend on the current set point parameter value ($I_{out}$).

Figure 3:
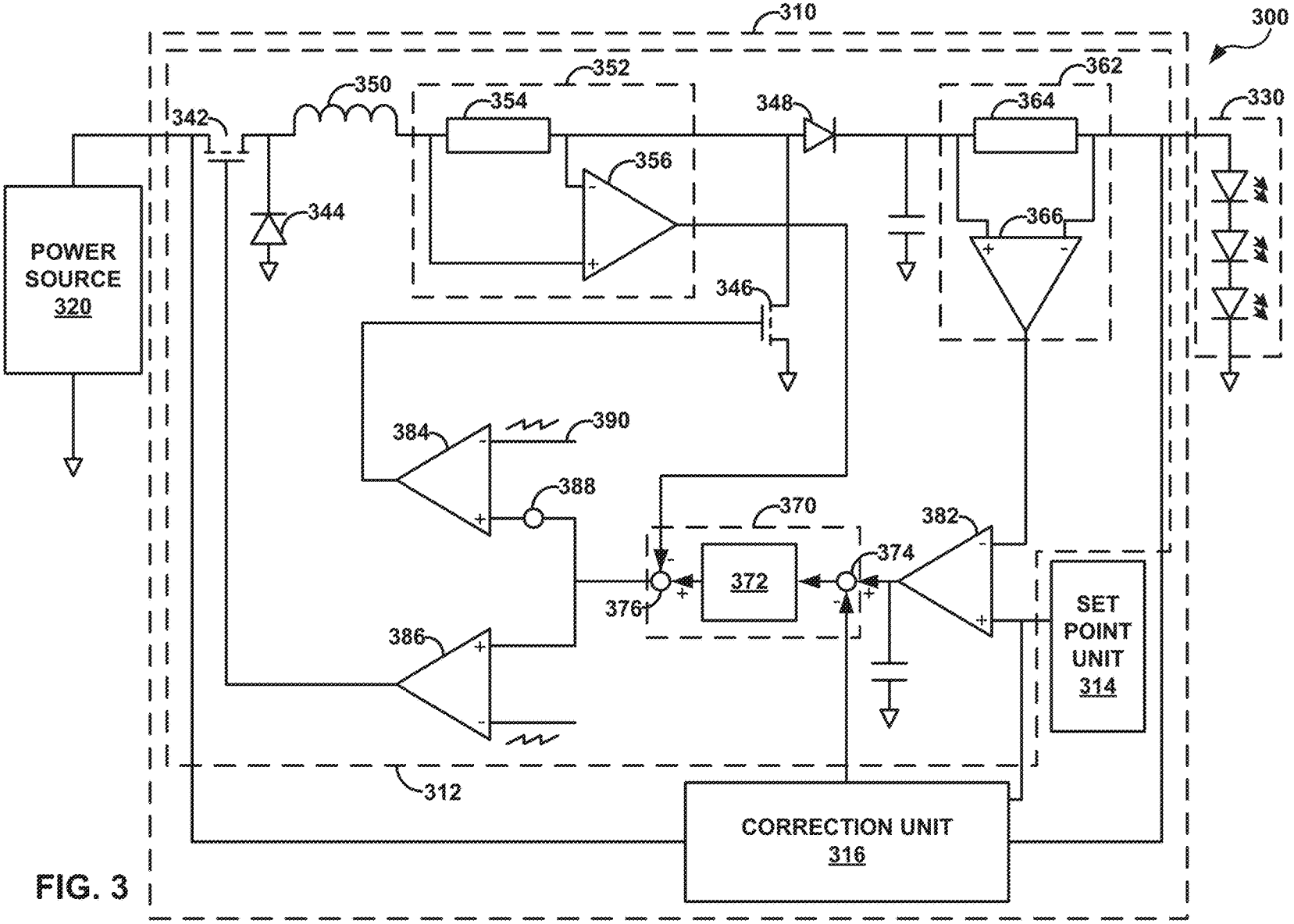
FIG. 3 is a circuit diagram illustrating another exemplary system including a circuit for accepting an input signal from a power source and delivering an output signal to one or more strings of LEDs, in accordance with one or more techniques of this disclosure.

FIG. 3 is a circuit diagram illustrating another exemplary system 300 including a circuit 310 for accepting an input signal from power source 320 and delivering an output signal to one or more strings of LEDs 330, in accordance with one or more techniques of this disclosure. As illustrated in FIG. 3, system 300 includes circuit 310, power source 320, and LEDs 330. Circuit 310 includes power converter unit 312, set point unit 314, and correction unit 316. Power converter unit 312 includes first switching element 342, first diode 344, second switching element 346, second diode 348, inductor 350, first current sensor 352, second current sensor 362, node 370, amplifier 382, amplifier 384, amplifier 386, and offset unit 388. First current sensor 352 includes first current sensing resistor 354 and first current sensing amplifier 356. Second current sensor 362 includes second current sensing resistor 364 and second current sensing amplifier 366. Node 370 includes a scaling unit 372, a first sub-node 374, and a second sub-node 376. Circuit 310 may be an example of circuit 110 of FIG. 1. Power converter unit 312 may be an example of power converter unit 312 of FIG. 1. Set point unit 314 may be an example of set point unit 114 of FIG. 1. Correction unit 316 may be an example of correction unit 116 of FIG. 1. Power source 320 may be an example of power source 120 of FIG. 1. LEDs 330 may be an example of LEDs 130 of FIG. 1.

System 300 may be substantially similar to the system 200 of FIG. 2, except that node 370 of FIG. 3 includes a scaling unit 372, a first sub-node 374, and a second sub-node 376, none of which are present in FIG. 2. Scaling unit 372 may affect the control signal produced by node 370. For example, first sub-node 374 may receive the comparison signal ($V_{comp}$) from amplifier 382, the comparison signal representing a difference between the set point parameter value delivered by set point unit 314 and the second current sensor signal delivered by second current sensor 362. Additionally, first sub-node 374 may receive the correction signal ($V_{correction}$) from correction unit 316. Second sub-node 376 may receive the first current sensor signal ($V_{peak}$) and output a control signal to amplifier 84. Scaling unit 372 may apply a scaling factor to the first current sensor signal, the offset signal ($V_{offset}$) given by offset unit 388, and the input 390 ($V_{slope}$) to amplifier 384. As such, the comparison signal may be given by:

$$V_{comp} = \frac{1}{K_{comp}} \cdot (V_{offset} + V_{slope} \cdot D + V_{peak}) + V_{correction} \quad \text{(eq. 8)}$$

In equation 8, $K_{comp}$ represents the scaling factor applied by the scaling unit 372. The correction signal may be given by:

$$V_{correction,ideal} = \frac{1}{K_{comp}} \cdot \frac{V_o}{V_i} \cdot R_{ext} \cdot (I_{out,max} - I_{out}) \text{ where} \quad \text{(eq. 9)}$$

$$I_{out,max} = \frac{V_{ref,max}}{A_{CS}} \cdot \frac{1}{R_{sense}}; \text{ and} \quad \text{(eq. 10)}$$

$$I_{out} = \frac{V_{ref}}{A_{CS}} \cdot \frac{1}{R_{sense}} \quad \text{(eq. 11)}$$

In equations 9-11, $R_{sense}$ may represent the resistance value of second current sensing resistor 364, and $A_{CS}$ may represent a gain of second current sensing amplifier 366. If equation 10 and equation 11 are combined with equation 9, the correction signal may be given by:

$$V_{correction,ideal} = \frac{1}{K_{comp}} \cdot \frac{V_o}{V_i} \cdot R_{ext} \cdot \left(\frac{V_{ref,max} - V_{ref}}{A_{CS} \cdot R_{sense}}\right) \quad \text{(eq. 12)}$$

In this way, in the example of FIG. 3, the correction signal may be proportional to the voltage gain of power converter unit 312 and the correction signal may be proportional to a difference between the set point parameter value and a maximum set point parameter value.

Figure 4A:
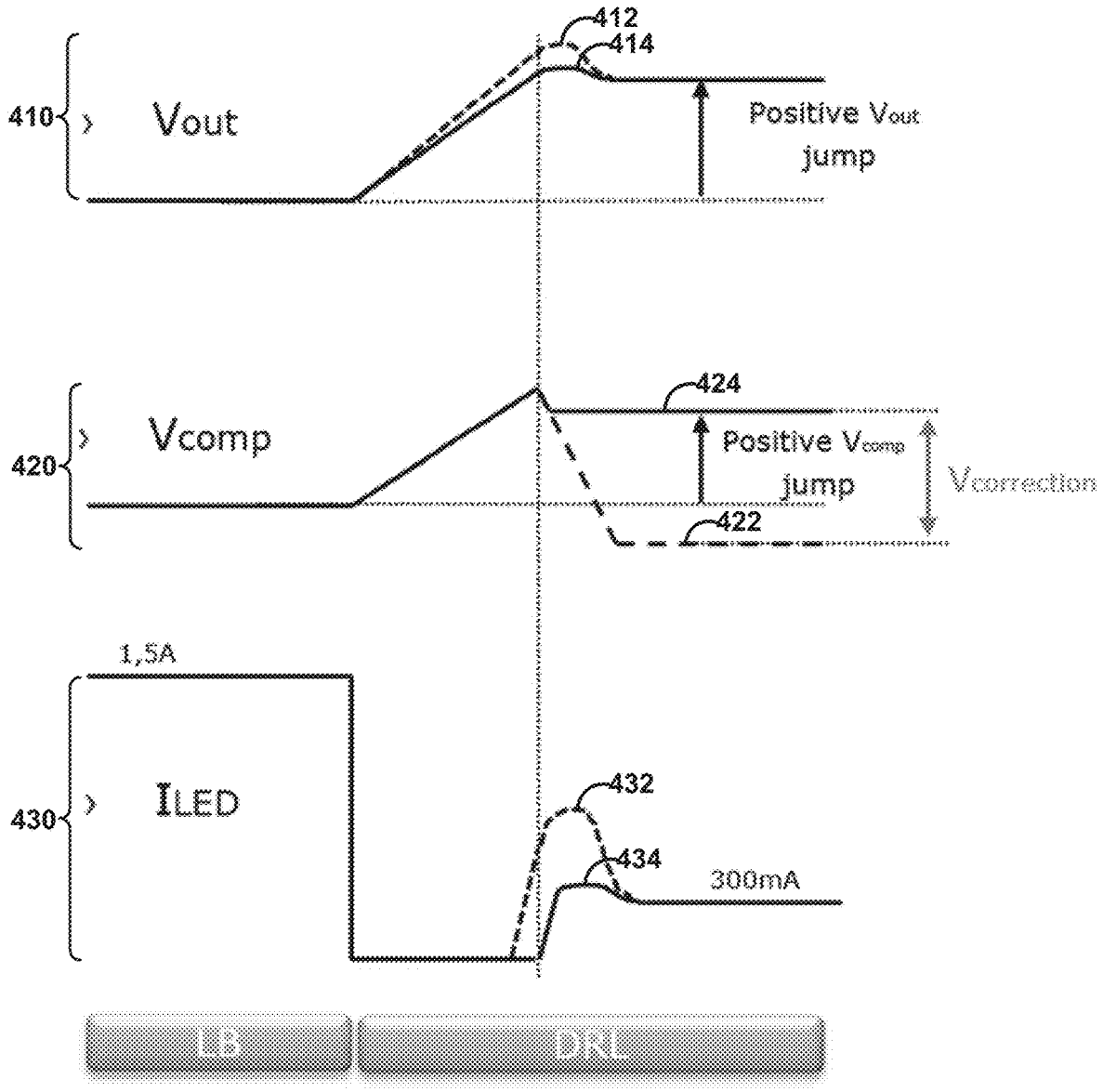
FIG. 4A is a graph illustrating an output voltage plot, a comparison signal plot, and an output current plot over a period of time in which output current is decreased from a first output current value to a second output current value, in accordance with one or more techniques of this disclosure.

FIG. 4A is a graph illustrating an output voltage plot 410, a comparison signal plot 420, and an output current plot 430 over a period of time in which output current is decreased from a first output current value to a second output current value, in accordance with one or more techniques of this disclosure. Output voltage plot 410 includes first output voltage curve 412 and second output voltage curve 414. Comparison signal plot 420 includes first comparison signal curve 422 and second comparison signal curve 424. Output current plot 430 includes first output current curve 432 and second output current curve 434.

Output voltage plot 410 represents an output voltage of power converter unit 112 that is delivered to LEDs 130 over a period of time. For example, since power converter unit 112 includes a switch/inductor unit that acts as a buck-boost converter, power converter unit 112 may step up (e.g., boost) or step down (e.g., buck) the output voltage from the input voltage delivered to power converter unit 112 by power source 120. By controlling one or more switching elements (e.g., switching elements 242, 246 of FIG. 2) of the switch/inductor unit, power converter unit 112 may switch the switch/inductor unit between a buck mode and a boost mode. Additionally, by controlling the one or more switching elements (e.g., regulating a duty cycle of one or more of switching elements 242, 246), power converter unit 112 may control an amount that power converter unit 112 steps up/steps down the output voltage, thus controlling the output voltage over the period of time. Additionally, the output voltage from power converter unit may be affected by devices and components other than power converter unit 112 (e.g., set point unit 114, correction unit 116, power source 120, and LEDs 130.

Set point unit 114 may provide a set point signal to power converter unit 112. Power converter unit 112 may regulate an output current delivered to LEDs 130 to be proportional to a set point parameter value associated with the set point signal. Power converter unit 112 may determine a comparison signal based on a difference between the set point signal and the output current. In order to regulate the output current, in some cases, power converter unit 112 may regulate the output voltage delivered to LEDs 130. Power converter unit 112 may regulate the output current, in some cases, to deliver an appropriate amount of current to LEDs 130 based on which LEDs of LEDs 130 are activated at a given time. For example, LEDs 130 may include a first string of LEDs having a set of high-beam LEDs and a set of low-beam LEDs. Additionally, LEDs 130 may include a second string of LEDs including a set of baseline LEDs. The set of baseline LEDs, in some cases, may be activated while the set of high-beam LEDs and the set of low-beam LEDs are deactivated, allowing the vehicle including LEDs 130 to be more easily spotted when the high-beams and the low-beams are off, such as during the daytime. As such, LEDs 130 may include a load that is supplied power by power converter unit 112, and the load may be transferred between the first set of LEDs and the second set of LEDs. For example, if the high-beams, the low-beams, or both the high-beams and the low-beams are activated, the load may be transferred from the second string of LEDs to the first string of LEDs. Additionally, if both the high-beams and the low-beams are deactivated, the load may be transferred from the first string of LEDs to the second string of LEDs. The second string of LEDs, in some cases, may require a lower amount of output current from power converter unit 112 than the first string of LEDs.

When the load of LEDs 130 is switched from the first string of LEDs to the second string of LEDs, in some cases, the output voltage may increase, and the comparison signal may decrease. For example, as seen in output current plot 430, the output current may decrease from 1.5 A to 0.3 A over a period of time. During the period of time, the output voltage may increase as seen in output voltage plot 410 and the comparison signal may decrease as seen in first comparison signal curve 422 of comparison signal plot 420. Such a decrease in comparison signal plot 420 may cause output current plot 430 to decrease from 1.5 A to below a final resting current of 0.3 A. Subsequently, output current plot 430 may increase above the final resting current of 0.3 A before settling at the final resting current of 0.3 A, as seen in first output current curve 432. As such, first output current curve 432 represents an output current overshoot that occurs due to switching the load of LEDs 130 from the first string of LEDs to the second string of LEDs.

Correction unit 116 may, in some cases decrease the amount of output current overshoot that occurs doe to transferring the load of LEDs 130 between the first string of LEDs and the second string of LEDs. For example, correction unit 116 delivers a correction signal to power converter unit 112 which prevents the comparison signal from decreasing when the output voltage increases. When correction unit 116 delivers the correction signal, comparison signal plot 420 shifts from the first comparison signal curve 422 to the second comparison signal curve 424. Additionally, when correction unit 116 delivers the correction signal, output signal plot 410 shifts from the first output voltage curve 412 to second output voltage curve 414. In this way, correction unit 116 additionally decreases output voltage overshoot as seen in the shift from the first output voltage curve 412 to second output voltage curve 414, and correction unit 116 prevents the comparison signal from decreasing when output voltage increases. As such, when correction unit 116 delivers the correction signal, the output current overshoot is decreased and the output current plot shifts from the first output current curve 432 to the second output current curve 434.

Figure 4B:
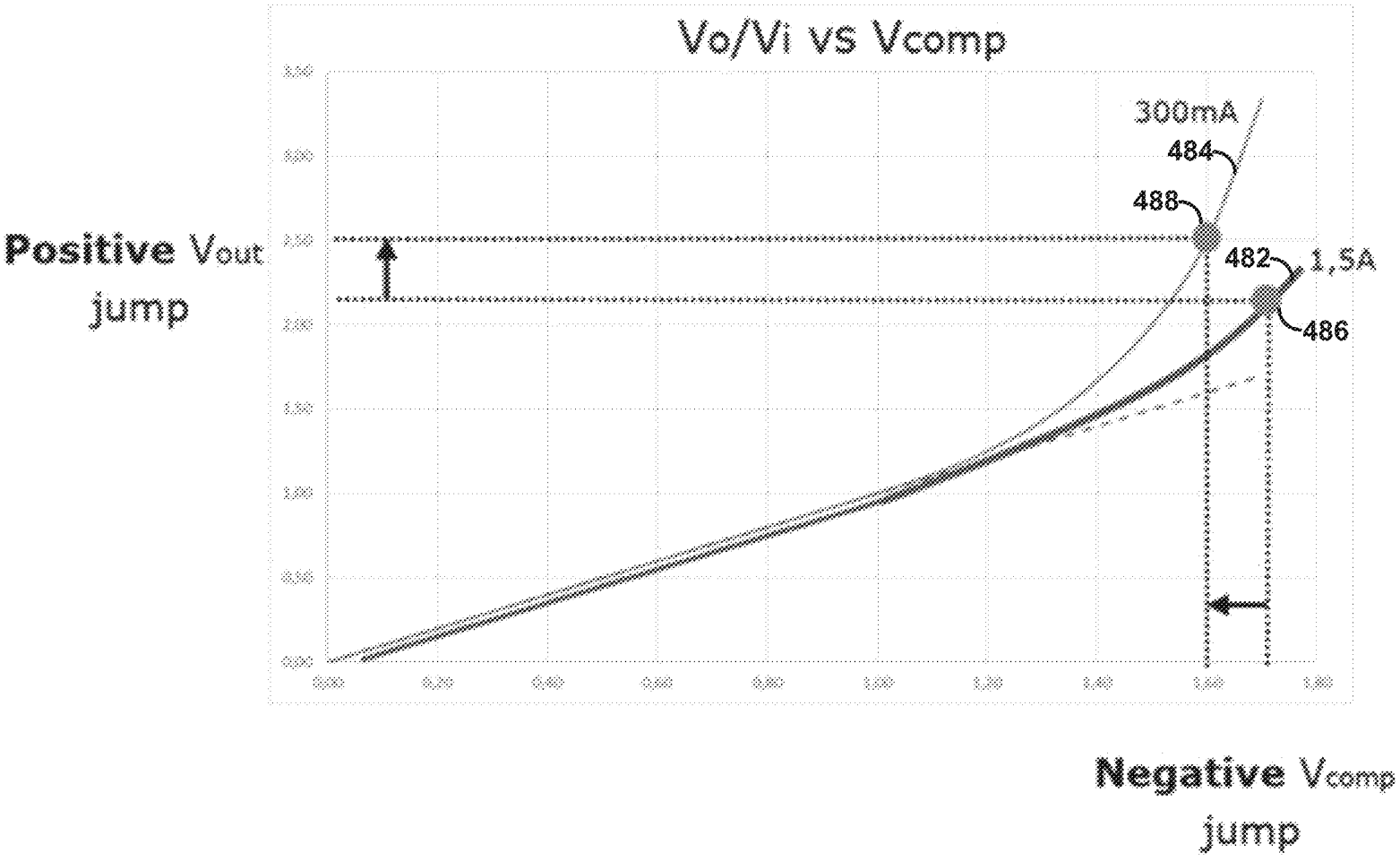
FIG. 4B is a graph illustrating a first gain/comparison signal plot and a second gain/comparison signal plot, in accordance with one or more techniques of this disclosure.

FIG. 4B is a graph illustrating a first gain/comparison signal plot 482 and a second gain/comparison signal plot 484, in accordance with one or more techniques of this disclosure. Additionally, FIG. 4B illustrates a first gain/comparison signal point 486 and a second gain/comparison signal plot 488. Circuit 210 may switch a load of LEDs 230 from a first string of LEDs to a second string of LEDs. While power converter unit 212 is operating in the boost mode, a relationship between the gain of power converter unit 212 and the comparison signal delivered to node 270 by amplifier 282 may be nonlinear. The nonlinear relationship may depend on the output current delivered by power converter unit 212 to LEDs 230. For example, if the output current is 1.5 A (e.g., when the load of LEDs 230 is the first string of LEDs), the relationship between the gain and the comparison signal may be given by first gain/comparison signal plot 482. Additionally, if the output current is 0.3 A (e.g., when the load of LEDs 230 is the second string of LEDs), the relationship between the gain and the comparison signal may be given by second gain/comparison signal plot 484. As such, when circuit 210 switches the load of LEDs 230 from the first string of LEDs to the second string of LEDs, the relationship between the gain and the comparison signal may shift from the first gain/comparison signal plot 482 to the second gain/comparison signal plot 484.

Additionally, when circuit 210 switches the load of LEDs 230 from the first string of LEDs to the second string of LEDs, an output voltage from power converter unit 212 may increase. As such the voltage gain of power converter unit 212 may likewise increase. Due to the change in the relationship between the gain and the comparison signal from the first gain/comparison signal plot 482 to the second gain/comparison signal plot 484, the increase in output voltage may correspond to a decrease in the comparison signal (e.g., the 'Positive $V_{out}$jump' corresponds to the 'Negative $V_{comp}$jump'). The decrease in the comparison signal may cause an overshoot in output current, as illustrated in FIG. 4A. Correction unit 216, in some cases, may be configured to deliver a correction signal to node 270, the correction signal eliminating the decrease in the comparison signal, thus decreasing the overshoot in the output current, as illustrated in FIG. 4A.

Figure 5A:
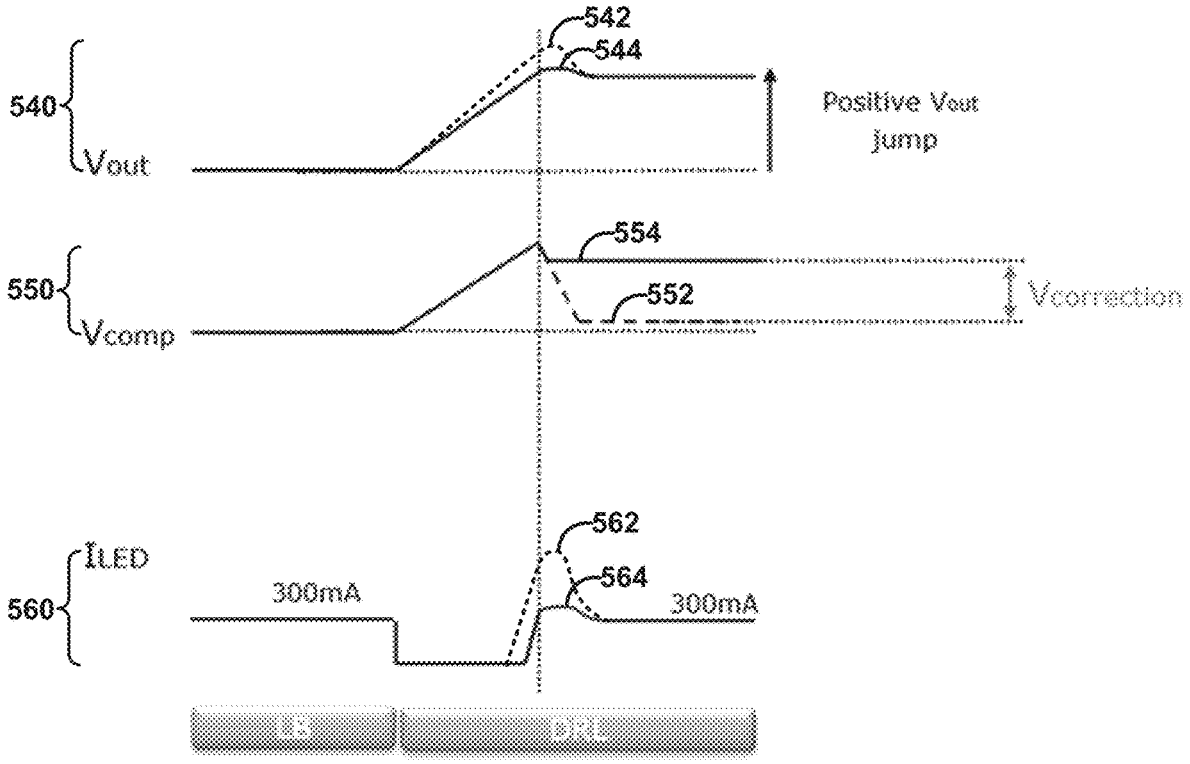
FIG. 5A is a graph illustrating an output voltage plot, a comparison signal plot, and an output current plot over a period of time in which output voltage is increased from a first output voltage value to a second output voltage value, in accordance with one or more techniques of this disclosure.

FIG. 5A is a graph illustrating an output voltage plot 540, a comparison signal plot 550, and an output current plot 560 over a period of time in which output voltage is increased from a first output voltage value to a second output voltage value, in accordance with one or more techniques of this disclosure. Output voltage plot 540 includes first output voltage curve 542 and second output voltage curve 544. Comparison signal plot 550 includes first comparison signal curve 552 and second comparison signal curve 554. Output current plot 560 includes first output current curve 562 and second output current curve 564.

Correction unit 116 may decrease an amount of output current overshoot that occurs due to a step up in output voltage while output current remains the same over a period of time (e.g., output current is the same at a time before the output voltage increase and at a time after the output current settles following the output voltage increase). For example, correction unit 116, in response to output voltage increasing from a first output voltage value to a second output voltage value, may deliver a correction signal to power converter unit 112 causing comparison signal plot 550 to shift from the first comparison signal curve 552 to the second comparison signal curve 554. Additionally, the correction signal causes output voltage plot 540 to shift from first output voltage curve 542 to second output voltage curve 544 and causes output current plot 560 to shift from first output current curve 562 to second output current curve 564. As such, correction unit 116 decreases an amount of output current overshoot that occurs due to an increase in output voltage from the first output voltage value to the second output voltage value.

Output voltage may increase, in some examples, if LEDs 130 include an LED string having a first group of LEDs and a second group of LEDs. If the first group of LEDs is activated and the second group of LEDs is deactivated, LEDs 130 may require the first output voltage value from power converter unit 112. If both the first group of LEDs and the second group of LEDs are activated, LEDs 130 may require the second output voltage value from power converter unit 112. As such, by activating the second group of LEDs, the output voltage plot 540 may increase from the first output voltage value to the second output voltage value.

Figure 5B:
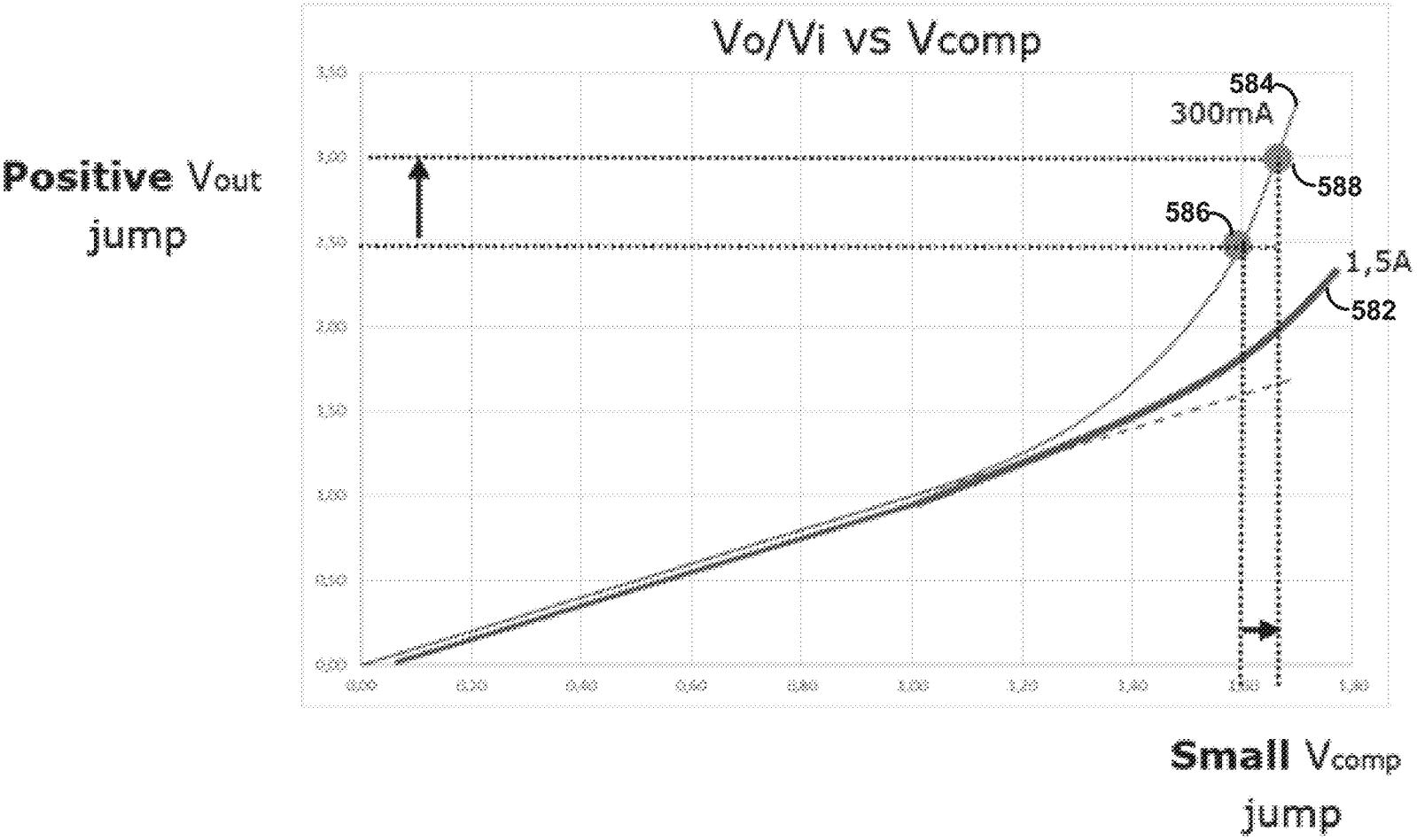
FIG. 5B is a graph illustrating a first gain/comparison signal plot and a second gain/comparison signal plot, in accordance with one or more techniques of this disclosure.

FIG. 5B is a graph illustrating a first gain/comparison signal plot 582 and a second gain/comparison signal plot 584, in accordance with one or more techniques of this disclosure. Additionally, FIG. 5B illustrates a first gain/comparison signal point 586 and a second gain/comparison signal plot 588. A load of LEDs 230 may, in some examples, include a single string of LEDs, where the single string of LEDs includes a first set of LEDs and a second set of LEDs. In some examples, circuit 210 may activate only the first set of LEDs. Additionally, in some examples, circuit 210 may activate both of the first set of LEDs and the second set of LEDs. When circuit 210 switches from activating only the first set of LEDs to activating both of the first set of LEDs and the second set of LEDs, the output voltage from power converter unit 212 may increase while the output current from power converter unit 212 remains constant from a time before activating both of the first set of LEDs and the second set of LEDs to a time after the output current settles following the activation of both of the first set of LEDs and the second set of LEDs.

After the activation of both of the first set of LEDs and the second set of LEDs, the output voltage from power converter unit 212 may increase (e.g., 'Positive $V_{out}$jump' illustrated in FIG. 5B). Since the relationship between the gain of power converter unit 212 and the comparison signal received by node 270 from amplifier 282 is nonlinear, as seen in second gain/comparison signal plot 584, an increase in output voltage may correspond to a relatively small increase in the comparison signal. Such a relatively small increase in the comparison signal may contribute to the output current overshoot illustrated in FIG. 5A. Correction unit 216, in some cases, may be configured to deliver a correction signal to node 270, the correction signal boosting the relatively small increase in the comparison signal, thus decreasing the overshoot in the output current, as illustrated in FIG. 5A. Since output current remains constant (e.g., 0.3 A) in the example of FIG. 5B from a time before activating both of the first set of LEDs and the second set of LEDs to a time after the output current settles following the activation of both of the first set of LEDs and the second set of LEDs, the relationship between the gain and the comparison signal may not deviate from second gain/comparison signal plot 584.

Figure 6:
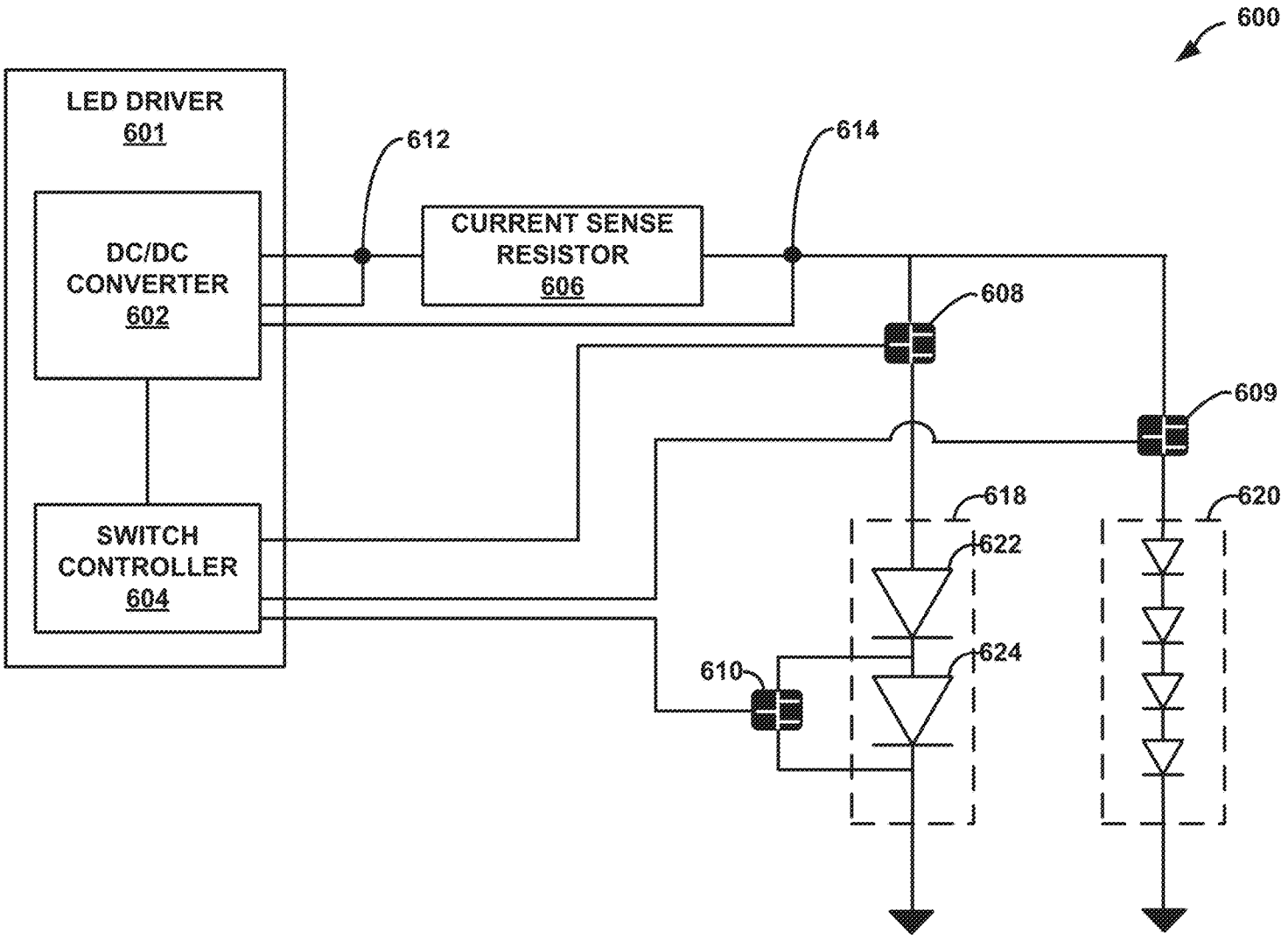
FIG. 6 is a block diagram illustrating an example system including a first LED string and a second LED string and an LED driver, in accordance with one or more techniques of this disclosure.

FIG. 6 is a block diagram illustrating an example system 600 including a first LED string 618 and a second LED string 620 and an LED driver 601, in accordance with one or more techniques of this disclosure. LED driver 601 includes a DC/DC converter 602 that is configured to regulate current through the first LED string 618 and the second LED string 620. LED driver 601 may also include a switch controller 604 that is configured to control switches 608 and 609 so as to control current flow through the first LED string 618 and the second LED string 620. In some examples, the phrase "LED string" refers to a plurality of LEDs that are coupled in series. DC/DC converter 602 may be an example of the switch/inductor unit of power converter unit 112 of FIG. 1. Current sense resistor 606 may be an example of second current sense resistor 264 of FIG. 2. LED string 618 and LED string 620 may be an example of LEDs 130 of FIG. 1.

First LED string 618 and second LED string 620 may be controlled in a complimentary fashion by controlling switch 608, controlling switch 609, and controlling switch 610 (collectively, "controlling switches 608, 609, 610. Switch controller 604 may control switch 608 to be in an on state while controlling switch 609 is in an off state. Alternatively, switch controller 604 may control switch 608 to be in an off state while controlling switch 609 is in an on state. In this way, switch controller 604 controls LED string 618 and second LED string 620 in a complimentary fashion, ensuring that both LED strings are not receiving substantial amounts of current at the same time. Switches 608 and 609 may be used to select different strings of LEDs at different times, and in some cases, switches 608 and 609 may be controlled to define duty cycles of first LED string 618 and second LED string 620 in order to more effectively control the power that is delivered to the different LED strings. Switch 610 may control whether LEDs 622 and LEDs 624 receive power while LED string 618 receives power, or whether LEDs 622 receive power and LEDs 624 do not receive power while LED string 618 receives power. As such, switch controller 604 may control whether both of LEDs 622, 624 are illuminated, or just LEDs 622 are illuminated while power is delivered to LED string 618.

As examples, each of switches 608, 609, 610 may include a Field Effect Transistor (FET), a bipolar junction transistor (BJT), a gallium nitride (GaN) switch, or possibly a silicon controlled rectifier (SCR). Examples of FETs may include, but are not limited to, junction field-effect transistor (JFET), metal-oxide-semiconductor FET (MOSFET), dual-gate MOSFET, insulated-gate bipolar transistor (IGBT), any other type of FET, or any combination of the same. Examples of MOSFETS may include, but are not limited to, PMOS, NMOS, DMOS, or any other type of MOSFET, or any combination of the same. Examples of BJTs may include, but are not limited to, PNP, NPN, heterojunction, or any other type of BJT, or any combination of the same.

In order to monitor and sense current flow through first LED string 618 and through second LED string 620, the circuit shown in FIG. 6 includes a current sense resistor 606 and two current sensing pins at nodes 612 and 614. The current sensing pins at nodes 612 and 614 are electrical contacts that couple to DC/DC converter 602. DC/DC converter 602 can monitor the voltage drop from node 612 to node 614. Based on the resistance of resistor 606 and the voltage drop from node 612 to node 614, DC/DC converter 602 can determine the current flow through first LED string 618 and the current flow through second LED string based on Ohm's law.

DC/DC converter 602 may represent the switch/inductor unit of power converter unit 112 of FIG. 1. In this way, DC/DC converter 602 may act as a buck-boost converter which controls an output signal (e.g., an output current and an output voltage) delivered to first LED string 618 and second LED string 620. First LED string 618 and second LED string 620 may each draw different amounts of current from DC/DC converter 602. In some cases, to sufficiently illuminate LEDs 622 and LEDs 624, first LED string 618 receives a 1.5 A current from DC/DC converter 602. Additionally, in some cases, to sufficiently illuminate the LEDs of second LED string 620, second LED string 620 receives a 0.3 A current from DC/DC converter 602. Switch controller 604 may control switch 608 and switch 609 such that DC/DC converter 602 delivers an output current to second LED string 620 and DC/DC converter 602 does not deliver the output current to first LED string 618. Since second LED string 620 may be powered by a second output current value and first LED string 618 may be powered by a first output current value, DC/DC converter 602 may decrease the output current from the first output current value to the second output current value if switch controller 604 shifts the output current from first LED string 618 to second output string 620 using switch 608 and switch 609.

By decreasing the output current from the first output current value to the second output current value, DC/DC converter 602 may cause an output current overshoot of the second output current value before the output current settles at the second output current value. A correction unit (not illustrated in FIG. 6) of LED driver 601 may deliver a correction signal which decreases such an output current overshoot.

Figure 7:
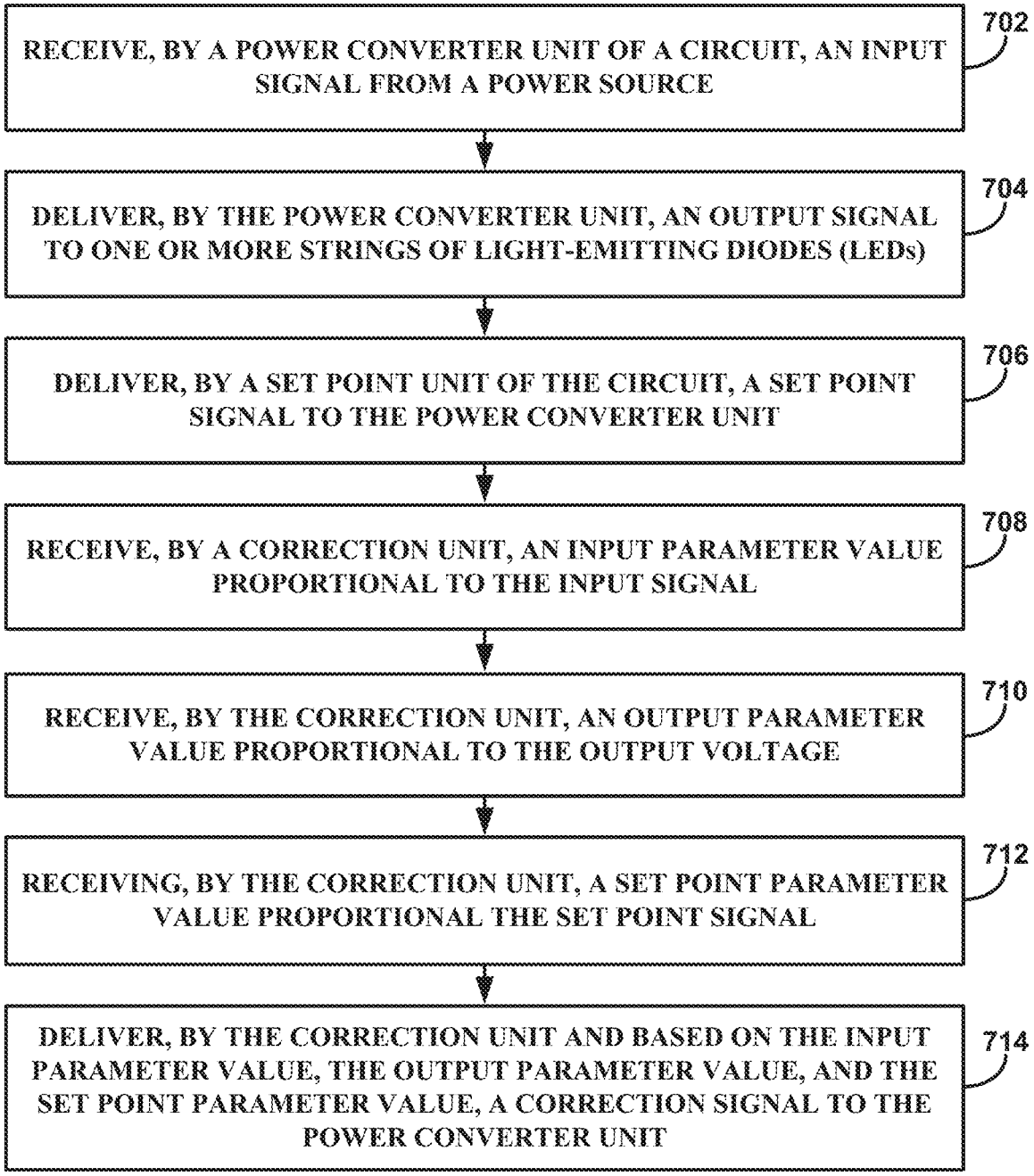
FIG. 7 is a flow diagram illustrating an example operation for delivering a correction signal in order to decrease output current overshoot, in accordance with one or more techniques of this disclosure.

FIG. 7 is a flow diagram illustrating an example operation for delivering a correction signal in order to decrease output current overshoot, in accordance with one or more techniques of this disclosure. For convenience, FIG. 7 is described with respect to circuit 110, power source 120, and LEDs 130 of FIG. 1. However, the techniques of FIG. 7 may be performed by different components of circuit 110, power source 120, and LEDs 130 or by additional or alternative devices.

As seen in the example operation of FIG. 7, Power converter unit 112 of circuit 110 is configured to receive an input signal from power source 120 (702). In some examples, the input signal includes an input voltage, an input current. Additionally, in some examples, the input signal may define any combination of an input frequency or an input duty cycle. Power converter unit 112 delivers an output signal to LEDs 130 (704). LEDs 130 may include one or more strings of LEDs. For example, LEDs 130 may include a first string of LEDs including a set of high-beam LEDs and a set of low-beam LEDs. Additionally, LEDs 130 may include a second string of LEDs representing a set of baseline LEDs. For example, if both of the set of low-beam LEDs and the set of high-beam LEDs are deactivated, circuit 110 may deliver the output signal to the second string of LEDs such that the set of baseline LEDs are activated. The second string of LEDs may, in some cases, give off a smaller amount of light than the first string of LEDs and draw a smaller amount of current from circuit 110 than the first string of LEDs. In this way, power converter unit 112 may regulate the output signal delivered to LEDs 130 in order to provide a correct amount of power depending on which string of the one or more strings of LEDs is activated.

Set point unit 114 of circuit 110 may deliver a set point signal to power converter unit 112 (706). In some examples, power converter unit 112 may regulate the output current delivered to LEDs 130 to be proportional to a set point parameter value associated with the set point signal. In this way, set point unit 114 may control the output current delivered to LEDs 130. Correction unit 116 of circuit 110 may receive an input parameter value proportional to the input signal (708). Additionally, correction unit 116 may receive an output parameter value proportional to the output voltage (710) and receive a set point parameter value proportional to the set point signal (712). Correction unit 116 delivers, based on the input parameter value, the output parameter value, and the set point parameter value, a correction signal to power converter unit 112 (714). By delivering the correction signal to power converter unit 112, correction unit 116 may decrease an amount of output signal overshoot that occurs due to a change in the set point parameter value, a change in the output signal, or a change in the input signal.

The following numbered examples demonstrate one or more aspects of the disclosure.

Example 1

A circuit is configured to monitor current through one or more strings of light-emitting diodes (LEDs), the circuit including a power converter unit, where the power converter unit is configured to receive an input signal from a power source, and where the power converter unit is configured to deliver an output signal to the one or more strings of LEDs, the output signal including an output voltage and an output current; a set point unit configured to deliver a set point signal to the power converter unit, where the power converter unit is configured to regulate the output current to be proportional to a set point parameter value associated with the set point signal; and a correction unit. The correction unit is configured to: receive an input parameter value, where the input parameter value is proportional to the input signal; receive an output parameter value, where the output parameter value is proportional to the output voltage; receive a set point parameter value, where the set point parameter value is proportional the set point signal; and deliver, based on the input parameter value, the output parameter value, and the set point parameter value, a correction signal to the power converter unit.

Example 2

The circuit of example 1, where the circuit is further configured to: transfer the output signal from a first string of the one or more strings of LEDs to a second string of the one or more strings of LEDs, where the set point unit is configured to: change, based on the transfer of the output signal, the set point parameter value from a first set point parameter value to a second set point parameter value, and where to deliver the correction signal to the power converter unit, the correction unit is configured to: deliver, based on a difference between a maximum set point parameter value and the second set point parameter value, the correction signal to the power converter unit in order to decrease an amount of output current overshoot corresponding to the transfer of the output signal.

Example 3

The circuit of examples 1-2 or any combination thereof, where a ratio of the output parameter value to the input parameter value represents a gain of the power converter unit, and where to deliver the correction signal, the correction unit is configured to: deliver the correction signal to the power converter unit based on the gain of the power converter unit.

Example 4

The circuit of examples 1-3 or any combination thereof, where the circuit is further configured to: change, based on the change of the set point parameter value from the first set point parameter value to the second set point parameter value, the output current from a first output current value correlated with the first set point parameter value to a second output current value correlated with the second set point parameter value.

Example 5

The circuit of examples 1-4 or any combination thereof, where the first output current value is within a range from 1.3 Amperes (A) to 1.7 A, and where the second output current value is within a range from 0.1 A to 0.5 A.

Example 6

The circuit of examples 1-5 or any combination thereof, where the circuit is further configured to: change the output voltage from a first output voltage value to a second output voltage value, and where to deliver the correction signal to the power converter unit, the correction unit is configured to: deliver, based on a difference between a maximum set point parameter value and the set point parameter value, the correction signal to the power converter unit in order to decrease an amount of output current overshoot corresponding to the change of the output voltage.

Example 7

The circuit of examples 1-6 or any combination thereof, where the input parameter value represents an input voltage value, and where a ratio of second the output voltage value to the input voltage value represents a voltage gain of the power converter unit, and where to deliver the correction signal, the correction unit is configured to: deliver the correction signal to the power converter unit based on the voltage gain of the power converter unit.

Example 8

The circuit of examples 1-7 or any combination thereof, where the power converter unit further includes an inductor, and where the power converter unit includes: a first current sensor including: a first current sensing resistor; and a first amplifier configured to output a first current sensor signal correlated with a current across the inductor and a current across the first current sensing resistor; and a second current sensor including: a second current sensing resistor connected in series with the first current sensing resistor; and a second amplifier configured to output a second current sensor signal correlated with the output current delivered to the one or more strings of LEDs and a current across the second current sensing resistor, where based on the first current sensor signal and the second current sensor signal, the power converter unit is configured to regulate at least one of the output current and the output voltage.

Example 9

The circuit of examples 1-8 or any combination thereof, where the power converter unit further includes a node and a switching element, where the node is configured to: receive the correction signal; receive the first current sensor signal; receive a comparison signal, where the comparison signal is correlated with a difference between the set point signal and the second current sensor signal; and output a control signal, where the control signal represents a summation of the correction signal, the first current sensor signal, and the comparison signal, and where the control signal controls a switching cycle of the switching element in order to regulate the at least one of the output current and the output voltage, where the switching element is configured to activate and deactivate according to the switching cycle and based on the control signal, the switching cycle defining a duty cycle representing a ratio of an amount of time that the switching element is activated to an amount of time that the switching element is deactivated.

Example 10

The circuit of examples 1-9 or any combination thereof, where while the switching element is activated, the power converter unit is configured to: charge the inductor, and where while the switching element is deactivated, the power converter unit is configured to: discharge the inductor to boost the output voltage value to the one or more strings of LEDs.

Example 11

The circuit of examples 1-10 or any combination thereof, where the switching element is a first switching element, where the power converter unit further includes a second switching element, where while the second switching element is activated and the first switching element is deactivated, the power converter unit is configured to: charge the inductor, and where while the second switching element is deactivated and the first switching element is deactivated, the power converter unit is configured to: discharge the inductor to buck the output voltage value to the one or more strings of LEDs.

Example 12

A system includes one or more strings of light-emitting diodes (LEDs); a power source; and a circuit configured to monitor current through one or more strings of LEDs, the circuit including: a power converter unit, where the power converter unit is configured to receive an input signal from a power source, and where the power converter unit is configured to deliver an output signal to the one or more strings of LEDs, the output signal including an output voltage and an output current; a set point unit configured to deliver a set point signal to the power converter unit, where the power converter unit is configured to regulate the output current to be proportional to a set point parameter value associated with the set point signal; and a correction unit configured to: receive an input parameter value, where the input parameter value is proportional to the input signal; receive an output parameter value, where the output parameter value is proportional to the output voltage; receive a set point parameter value, where the set point parameter value is proportional the set point signal; and deliver, based on the input parameter value, the output parameter value, and the set point parameter value, a correction signal to the power converter unit.

Example 13

The system of example 12, where the circuit is further configured to: transfer the output signal from a first string of the one or more strings of LEDs to a second string of the one or more strings of LEDs, where the set point unit is configured to: change, based on the transfer of the output signal, the set point parameter value from a first set point parameter value to a second set point parameter value, and where to deliver the correction signal to the power converter unit, the correction unit is configured to: deliver, based on a difference between a maximum set point parameter value and the second set point parameter value, the correction signal to the power converter unit in order to decrease an amount of output current overshoot corresponding to the transfer of the output signal.

Example 14

The system of examples 12-13 or any combination thereof, where a ratio of the output parameter value to the input parameter value represents a gain of the power converter unit, and where to deliver the correction signal, the correction unit is configured to: deliver the correction signal to the power converter unit based on the gain of the power converter unit.

Example 15

The system of examples 12-14 or any combination thereof, where a ratio of the output parameter value to the input parameter value represents a gain of the power converter unit, and where to deliver the correction signal, the correction unit is configured to: deliver the correction signal to the power converter unit based on the gain of the power converter unit.

Example 16

The system of examples 12-15 or any combination thereof, where the circuit is further configured to: change, based on the change of the set point parameter value from the first set point parameter value to the second set point parameter value, the output current from a first output current value correlated with the first set point parameter value to a second output current value correlated with the second set point parameter value.

Example 17

The system of examples 12-16 or any combination thereof, where the first output current value is within a range from 1.3 Amperes (A) to 1.7 A, and where the second output current value is within a range from 0.1 A to 0.5 A.

Example 18

The system of examples 12-17 or any combination thereof, where the circuit is further configured to: change the output voltage from a first output voltage value to a second output voltage value, and where to deliver the correction signal to the power converter unit, the correction unit is configured to: deliver, based on a difference between a maximum set point parameter value and the set point parameter value, the correction signal to the power converter unit in order to decrease an amount of output current overshoot corresponding to the change of the output voltage.

Example 19

The system of examples 12-18 or any combination thereof, where the input parameter value represents an input voltage value, and where a ratio of second the output voltage value to the input voltage value represents a voltage gain of the power converter unit, and where to deliver the correction signal, the correction unit is configured to: deliver the correction signal to the power converter unit based on the voltage gain of the power converter unit.

Example 20

A method includes receiving, by a power converter unit of a circuit configured to monitor current through one or more strings of light-emitting diodes (LEDs), an input signal from a power source; delivering, by the power converter unit, an output signal to the one or more strings of LEDs, the output signal including an output voltage and an output current; delivering, by a set point unit of the circuit, a set point signal to the power converter unit, the power converter unit regulating the output current to be proportional to a set point parameter value associated with the set point signal; receiving, by a correction unit, an input parameter value, where the input parameter value is proportional to the input signal; receiving, by the correction unit, an output parameter value, where the output parameter value is proportional to the output voltage; receiving, by the correction unit, a set point parameter value, where the set point parameter value is proportional the set point signal; and delivering, by the correction unit and based on the input parameter value, the output parameter value, and the set point parameter value, a correction signal to the power converter unit.

Various examples of the disclosure have been described. These and other examples are within the scope of the following claims.

What is claimed is:

1. A circuit configured to monitor current through one or more strings of light-emitting diodes (LEDs), the circuit comprising:

a power converter unit, wherein the power converter unit is configured to receive an input signal from a power source, and wherein the power converter unit is configured to deliver an output signal to the one or more strings of LEDs, the output signal comprising an output voltage and an output current;

a set point unit configured to deliver a set point signal to the power converter unit, wherein the power converter unit is configured to regulate the output current to be proportional to a set point parameter value associated with the set point signal; and a correction unit configured to:

receive an input parameter value, wherein the input parameter value is proportional to the input signal;

receive an output parameter value, wherein the output parameter value is proportional to the output voltage;

receive a set point parameter value, wherein the set point parameter value is proportional the set point signal; and deliver, based on the input parameter value, the output parameter value, and the set point parameter value, a correction signal to the power converter unit.

2. The circuit of claim 1, wherein the circuit is further configured to:

transfer the output signal from a first string of the one or more strings of LEDs to a second string of the one or more strings of LEDs, wherein the set point unit is configured to:

change, based on the transfer of the output signal, the set point parameter value from a first set point parameter value to a second set point parameter value, and wherein to deliver the correction signal to the power converter unit, the correction unit is configured to:

deliver, based on a difference between a maximum set point parameter value and the second set point parameter value, the correction signal to the power converter unit in order to decrease an amount of output current overshoot corresponding to the transfer of the output signal.

3. The circuit of claim 2, wherein a ratio of the output parameter value to the input parameter value represents a gain of the power converter unit, and wherein to deliver the correction signal, the correction unit is configured to:

deliver the correction signal to the power converter unit based on the gain of the power converter unit.

4. The circuit of claim 2, wherein the circuit is further configured to:

change, based on the change of the set point parameter value from the first set point parameter value to the second set point parameter value, the output current from a first output current value correlated with the first set point parameter value to a second output current value correlated with the second set point parameter value.

5. The circuit of claim 4, wherein the first output current value is within a range from 1.3 Amperes (A) to 1.7 A, and wherein the second output current value is within a range from 0.1 A to 0.5 A.

6. The circuit of claim 1, wherein the circuit is further configured to:

change the output voltage from a first output voltage value to a second output voltage value, and wherein to deliver the correction signal to the power converter unit, the correction unit is configured to:

deliver, based on a difference between a maximum set point parameter value and the set point parameter value, the correction signal to the power converter unit in order to decrease an amount of output current overshoot corresponding to the change of the output voltage.

7. The circuit of claim 6, wherein the input parameter value represents an input voltage value, and wherein a ratio of second the output voltage value to the input voltage value represents a voltage gain of the power converter unit, and wherein to deliver the correction signal, the correction unit is configured to:

deliver the correction signal to the power converter unit based on the voltage gain of the power converter unit.

8. The circuit of claim 1, wherein the power converter unit further comprises an inductor, and wherein the power converter unit comprises:

a first current sensor comprising:

a first current sensing resistor; and a first amplifier configured to output a first current sensor signal correlated with a current across the inductor and a current across the first current sensing resistor; and a second current sensor comprising:

a second current sensing resistor connected in series with the first current sensing resistor; and a second amplifier configured to output a second current sensor signal correlated with the output current delivered to the one or more strings of LEDs and a current across the second current sensing resistor, wherein based on the first current sensor signal and the second current sensor signal, the power converter unit is configured to regulate at least one of the output current and the output voltage.

9. The circuit of claim 8, wherein the power converter unit further comprises a node and a switching element, wherein the node is configured to:

receive the correction signal;

receive the first current sensor signal;

receive a comparison signal, wherein the comparison signal is correlated with a difference between the set point signal and the second current sensor signal; and output a control signal, wherein the control signal represents a summation of the correction signal, the first current sensor signal, and the comparison signal, and wherein the control signal controls a switching cycle of the switching element in order to regulate the at least one of the output current and the output voltage, wherein the switching element is configured to activate and deactivate according to the switching cycle and based on the control signal, the switching cycle defining a duty cycle representing a ratio of an amount of time that the switching element is activated to an amount of time that the switching element is deactivated.

10. The circuit of claim 9, wherein while the switching element is activated, the power converter unit is configured to:

charge the inductor, and wherein while the switching element is deactivated, the power converter unit is configured to:

discharge the inductor to boost the output voltage value to the one or more strings of LEDs.

11. The circuit of claim 10, wherein the switching element is a first switching element, wherein the power converter unit further comprises a second switching element, wherein while the second switching element is activated and the first switching element is deactivated, the power converter unit is configured to:

charge the inductor, and wherein while the second switching element is deactivated and the first switching element is deactivated, the power converter unit is configured to:

discharge the inductor to buck the output voltage value to the one or more strings of LEDs.

12. A system comprising:

one or more strings of light-emitting diodes (LEDs);

a power source; and a circuit configured to monitor current through one or more strings of LEDs, the circuit comprising:

a power converter unit, wherein the power converter unit is configured to receive an input signal from a power source, and wherein the power converter unit is configured to deliver an output signal to the one or more strings of LEDs, the output signal comprising an output voltage and an output current;

a set point unit configured to deliver a set point signal to the power converter unit, wherein the power converter unit is configured to regulate the output current to be proportional to a set point parameter value associated with the set point signal; and a correction unit configured to:

receive an input parameter value, wherein the input parameter value is proportional to the input signal;

receive an output parameter value, wherein the output parameter value is proportional to the output voltage;

receive a set point parameter value, wherein the set point parameter value is proportional the set point signal; and deliver, based on the input parameter value, the output parameter value, and the set point parameter value, a correction signal to the power converter unit.

13. The system of claim 12, wherein the circuit is further configured to:

transfer the output signal from a first string of the one or more strings of LEDs to a second string of the one or more strings of LEDs, wherein the set point unit is configured to:

change, based on the transfer of the output signal, the set point parameter value from a first set point parameter value to a second set point parameter value, and wherein to deliver the correction signal to the power converter unit, the correction unit is configured to:

deliver, based on a difference between a maximum set point parameter value and the second set point parameter value, the correction signal to the power converter unit in order to decrease an amount of output current overshoot corresponding to the transfer of the output signal.

14. The system of claim 13, wherein a ratio of the output parameter value to the input parameter value represents a gain of the power converter unit, and wherein to deliver the correction signal, the correction unit is configured to:

deliver the correction signal to the power converter unit based on the gain of the power converter unit.

15. The system of claim 13, wherein a ratio of the output parameter value to the input parameter value represents a gain of the power converter unit, and wherein to deliver the correction signal, the correction unit is configured to:

deliver the correction signal to the power converter unit based on the gain of the power converter unit.

16. The system of claim 13, wherein the circuit is further configured to:

change, based on the change of the set point parameter value from the first set point parameter value to the second set point parameter value, the output current from a first output current value correlated with the first set point parameter value to a second output current value correlated with the second set point parameter value.

17. The system of claim 16, wherein the first output current value is within a range from 1.3 Amperes (A) to 1.7 A, and wherein the second output current value is within a range from 0.1 A to 0.5 A.

18. The system of claim 12, wherein the circuit is further configured to:

change the output voltage from a first output voltage value to a second output voltage value, and wherein to deliver the correction signal to the power converter unit, the correction unit is configured to:

deliver, based on a difference between a maximum set point parameter value and the set point parameter value, the correction signal to the power converter unit in order to decrease an amount of output current overshoot corresponding to the change of the output voltage.

19. The system of claim 18, wherein the input parameter value represents an input voltage value, and wherein a ratio of second the output voltage value to the input voltage value represents a voltage gain of the power converter unit, and wherein to deliver the correction signal, the correction unit is configured to:

deliver the correction signal to the power converter unit based on the voltage gain of the power converter unit.

20. A method comprising:

receiving, by a power converter unit of a circuit configured to monitor current through one or more strings of light-emitting diodes (LEDs), an input signal from a power source;

delivering, by the power converter unit, an output signal to the one or more strings of LEDs, the output signal comprising an output voltage and an output current;

delivering, by a set point unit of the circuit, a set point signal to the power converter unit, the power converter unit regulating the output current to be proportional to a set point parameter value associated with the set point signal;

receiving, by a correction unit, an input parameter value, wherein the input parameter value is proportional to the input signal;

receiving, by the correction unit, an output parameter value, wherein the output parameter value is proportional to the output voltage;

receiving, by the correction unit, a set point parameter value, wherein the set point parameter value is proportional the set point signal; and delivering, by the correction unit and based on the input parameter value, the output parameter value, and the set point parameter value, a correction signal to the power converter unit.

* * * * *